US005243387A

United States Patent [19]

Ikegawa

[11] Patent Number: 5,243,387

[45] Date of Patent: Sep. 7, 1993

[54] CHARGING DEVICE WITH A LOOSELY MOUNTED FLEXIBLE MEMBER

[75] Inventor: Akihito Ikegawa, Sakai, Japan

[73] Assignee: Minolta Camera Kabushiki Kaisha, Osaka, Japan

[21] Appl. No.: 810,199

[22] Filed: Dec. 19, 1991

[30] Foreign Application Priority Data

Dec. 28, 1990 [JP] Japan ..... 2-408721

[51] Int. Cl.[5] ..... G03G 15/02

[52] U.S. Cl. ..... 355/219; 361/225

[58] Field of Search ..... 355/219; 361/225, 230, 361/233; 250/324-326

[56] References Cited

U.S. PATENT DOCUMENTS 4,380,384 4/1983 Ueno et al. ..... 355/219
4,727,453 2/1988 Ewing ..... 361/225
4,791,882 12/1988 Enoguchi et al. ..... 118/653
4,922,299 5/1990 Uchimoto et al. ..... 355/219
4,967,231 10/1990 Hosoya et al. ..... 355/219

*Primary Examiner*—A. T. Grimley
*Assistant Examiner*—William J. Royer
*Attorney, Agent, or Firm*—Willian Brinks Olds Hofer Gilson Lione

[57] ABSTRACT

A charging device for charging a surface of an electrostatic latent image support member used in an image forming apparatus. The apparatus has a rotatably disposed roller confronting the electrostatic latent image support member, a cylindrically formed flexible member having a peripheral length longer than that of the roller and loosely mounted therearound, a guide member for biasing the flexible member against the roller to form a slack of the flexible member at a location confronting the electrostatic latent image support member so that the slack of the flexible member is brought into contact with the electrostatic latent image support member, and a power supply for applying a voltage to the flexible member.

12 Claims; 3 Drawing Sheets

CHARGING DEVICE WITH A LOOSELY MOUNTED FLEXIBLE MEMBER

BACKGROUND OF THE INVENTION

1. Field of the Invention

The present invention relates to a charging device for charging an electrostatic latent image support member in an electrophotographic image forming apparatus such as copying machines and printers.

2. Description of Related Art

In an electrophotographic image forming apparatus, a charging device charges a surface of an electrostatic latent image support member such as a photosensitive drum, and the charged area is subjected to image exposure to form an electrostatic latent image. The latent image is visualized by a developing device to form a visible image, which is transferred to transfer material and is fixed thereon.

As is well known in the art, there have been charging devices utilizing corona discharge, and charging devices of a contact type using charging brushes or charging rollers.

Also, U.S. Pat. No. 4,380,384 has disclosed a charging device in which an endless belt, which is driven to rotate, contacts a surface of an electrostatic latent image support member, and a voltage is applied to the belt.

In the charging device, utilizing the corona discharge has such an advantage that the construction is simple and the charging can be stably performed. However, it generates a large amount of ozone, which may deteriorate the electrostatic latent image support member and may adversely affect human bodies.

The charging device using the charging brush or the charging roller has such an advantage that the construction is simple and the amount of generated ozone is extremely small as compared with the corona charging device. However, it is difficult to perform uniform charging, and the reliability is low.

Further, in the charging device using the charging roller, since the roller is pressed against the electrostatic latent image support member with a constant pressing force, the roller tends to deform, which may cause defective charging. This also reduces the reliability.

In the charging device of the belt type disclosed in the U.S. Pat. No. 4,380,384, the amount of the generated ozone is extremely small as compared with the corona charging device, and also has such an advantage over the brush charging and roller charging that an area contacting the electrostatic latent image support member is large so that uniform charging can be performed, resulting in high reliability, and that flexible contact is achieved so that the damage to the electrostatic latent image support member can be suppressed. However, it disadvantageously has a large construction and requires a complicated driving mechanism. These disadvantages cannot be ignored in view of the demand for compact image forming apparatus in these days.

SUMMARY OF INVENTION

Accordingly, it is an object of the invention to provide a charging device in which an amount of generated ozone is small, damage to an electrostatic latent image support member is suppressed, desired charging can be stably performed for a long term, reliability is high, a driving mechanism is simple, and a whole construction is compact.

In accordance with the above object, the invention provides a charging device for charging a surface of an electrostatic latent image, support member used in an image forming apparatus which comprises:

a rotatably disposed roller confronting said electrostatic latent image support member;

a cylindrically formed flexible member having a peripheral length longer than that of said roller and loosely mounted therearound;

means for biasing said flexible member against said roller to form a slack of said flexible member at a location confronting said electrostatic latent image support member so that said slack of the flexible member is brought into contact with said electrostatic latent image support member; and means for applying a voltage to said flexible member.

In another aspect of the invention, said means for biasing said flexible member may be means for bringing said flexible outer member partly into contact with said roller to define a space between said roller and said outer member at a location confronting said electrostatic latent image support member so that an external peripheral surface of the outer member covering said space is brought into contact with said electrostatic latent image support member.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENT

An embodiment of the invention will be described below with reference to the drawings.

Figure 1:
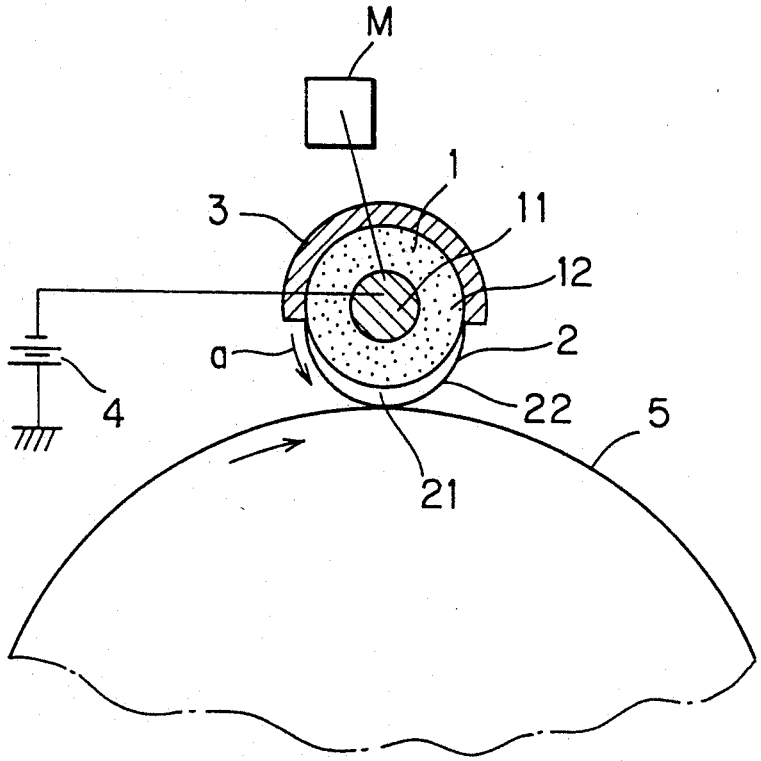
FIG. 1 is a cross section showing an embodiment of the invention together with a photosensitive drum.
Figure 2:
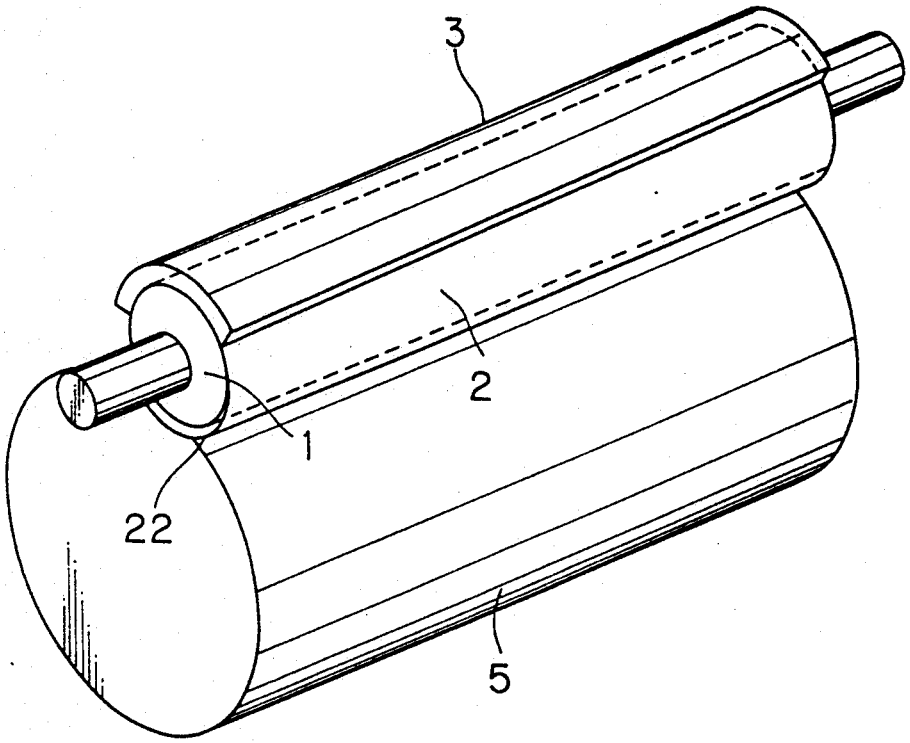
FIG. 2 is a fragmentary perspective view showing the embodiment in FIG. 1 together with a photosensitive drum.

FIG. 1 is a cross section showing a schematic construction of a charging device of an embodiment together with an electrostatic latent image support member in the form of photosensitive drum in an image forming apparatus. FIG. 2 is a fragmentary perspective view showing the charging device in FIG. 1 and the photosensitive drum.

The charging device comprises a roller 1 which is driven to rotate by appropriate driving means such as an electric motor M, a cylindrical member 2 disposed around the roller 1, and a guide member 3 for pressing the cylindrical member 2 against the roller 1. An electric power supply 4 applies a charging voltage to the cylindrical member 2.

At least a surface layer of the roller 1 is preferably made from elastic material having a large coefficient of friction with respect to the thin cylindrical member 2. Such elastic material may be electrically conductive elastic material containing, for example, silicon or urethane as principal component. In the illustrated embodiment, the roller 1 has a diameter of 24 mm and is formed of a shaft 11 and a surface layer 12 surrounding the shaft 11. The shaft 11 is formed of metal. The layer 12 is formed of electrically conductive silicon foam material and has a specific resistance of about $10^3$ Ωcm or less. The roller 1 is driven by the motor M at a peripheral speed of 5 cm/sec in a direction indicated by an arrow a in FIG. 1.

The cylindrical member 2 preferably has an electrical conductivity, and may be formed of metal or electrically conductive resin. A thickness of the member 2 may be about 20–40 μm, if it is metal, and may be about 100–300 μm, if it is resin. An appropriate specific resistance thereof is about $10^{-3}$–$10^7$ Ωcm. In the illustrated embodiment, the cylindrical member 2 is formed of conductive polyamide (nylon) having a specific resistance of about $10^6$ Ωcm or less, and is flexible. The member has a thickness of about 150 μm or less and an inner diameter of 25 mm such that the peripheral length of the member is longer than the peripheral length of the roller so as to be loosely mounted therearound.

The guide member 3 is associated with the cylindrical member 2. The guide member 3 is preferably made from material having a small coefficient of friction with respect to the thin cylindrical member 2, and is made from, for example, fluororesin such as polytetrafluoroethylene (Teflon, etc.), or polyacetal. In the illustrated embodiment, the guide member 3 is made from the polyacetal, and is brought or pressed against the cylindrical member 2 at a backup force of about 2 g/mm or less by appropriate biasing means (not shown) such as elastic synthetic resin (e.g., elastic sponge) or a spring.

The guide member 3 may be disposed to confront only a parts(s) or portion(s) (e.g., opposite ends) of the cylindrical member 2, if the guide member 3 can sufficiently press the cylindrical member 2 against the roller 1.

Owing to the pressing action by the guide member 3, the cylindrical member 2 is driven to rotate by the roller 1 by virtue of a frictional force therebetween. Also, owing to the pressing action, the cylindrical member 2 slackens to form a space 21 between the roller 1 and a portion 22 thereof remote from the pressed portion, i.e., the portion 22 confronting a photosensitive drum 5. The external peripheral surface of this slack portion 22 covering the space 21 flexibly contacts the surface of the photosensitive drum 5 through a wide area.

The drum 5 is an organic photosensitive drum having an outer diameter of 30 mm, and is rotated at a peripheral speed of 3.5 cm/sec by driving means (not shown).

According to the charging device described hereinabove, the photosensitive drum 5 is rotated, and the power supply 4 applies the charging voltage to the cylindrical member 2 through the roller 1. Also, the roller 1 is rotated by the motor M in the direction of the arrow a in FIG. 1. The cylindrical member 2 is driven by the roller 1 with the slack portion 22 in contact with the surface of the photosensitive drum 5. In this manner, the surface of the drum 5 is charged.

Figure 3:
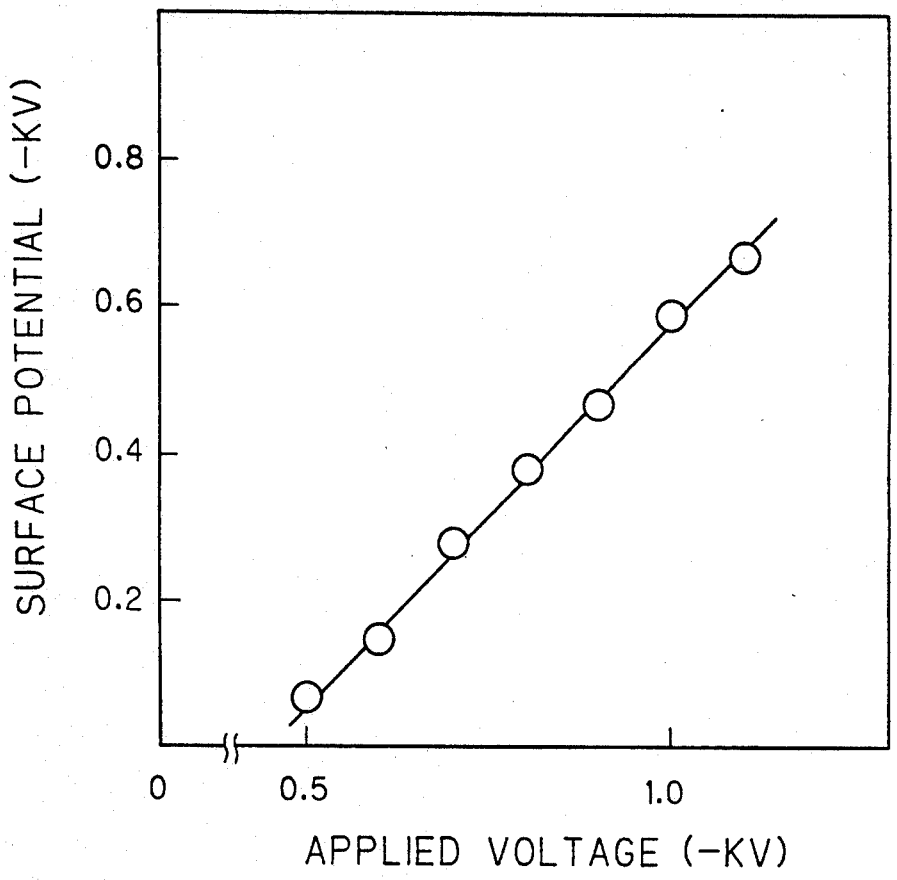
FIG. 3 is a graph showing a relationship between a voltage applied to a thin cylindrical member and a charged potential on a surface of a photosensitive drum.

FIG. 3 shows a relationship between a voltage applied to the cylindrical member 2 and a charged potential on the surface of the drum 5.

According to the charging device described above, since the cylindrical member 2, i.e., a charging member is driven to rotate by a simple driving mechanism, the whole construction is compact. Since the cylindrical member 2 flexibly contacts the photosensitive member 5 through a wide area, the damage to the photosensitive member is suppressed and the desired charging operation can be reliably performed for a long term, which increases the reliability of the charging device. Further, since the device is of the contact charging type, generation of ozone can be suppressed.

Although the guide member 3 is used in the above embodiment as a biasing means for pressing the cylindrical member 2 against the roller 1, the cylindrical member 2 may be pressed by magnetic force which is applied from a magnetic member fixedly provided in the roller 1 in case where the cylindrical member 2 is formed of metal.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A charging device for charging a surface of an electrostatic latent image support member used in an image forming apparatus, which comprises:

a rotatably disposed roller confronting said electrostatic latent image support member;

a cylindrically formed flexible member having a peripheral length longer than that of said roller and loosely mounted therearound;

means for biasing said flexible member against said roller to form a slack of said flexible member at a location confronting said electrostatic latent image support member so that said slack of the flexible member is brought into contact with said electrostatic latent image support member; and means for applying a voltage to said flexible member.

2. A charging device as claimed in claim 1, wherein said roller comprises a surface layer made from electrically conductive material.

3. A charging device as claimed in claim 1, wherein said biasing means is made from material having a small coefficient of friction with respect to said flexible member.

4. A charging device as claimed in claim 1, wherein said flexible member has a specific resistance in a range from $10^{-3}$ to $10^7$ Ωcm.

5. A charging device as claimed in claim 4, wherein said flexible member is made from metal and has a thickness in a range from about 20 μm to about 40 μm.

6. A charging device as claimed in claim 4, wherein said flexible member is made from electrically conductive resin and has a thickness in a range from about 100 μm to about 300 μm.

7. A charging device for charging a surface of an electrostatic latent image support member used in an image forming apparatus, which comprises:

a rotatably disposed roller confronting said electrostatic latent image support member;

a cylindrically formed flexible member having a peripheral length longer than that of said roller and loosely mounted therearound;

means for bringing said flexible member into contact with a part of said roller to define a space between said roller and said flexible member at a location confronting said electrostatic latent image support member so that an external peripheral surface of the flexible member covering said space is brought into contact with said electrostatic latent image support member; and means for applying a voltage to said flexible member.

8. A charging device as claimed in claim 7, wherein said roller comprises a surface layer made from electrically conductive material.

9. A charging device as claimed in claim 7, wherein said bringing means is made from material having a small coefficient of friction with respect to said flexible member.

10. A charging device as claimed in claim 7, wherein said flexible member has a specific resistance in a range from $10^{-3}$ to $10^{7}$ Ωcm.

11. A charging device as claimed in claim 10, wherein said flexible member is made from metal and has a thickness in a range from about 20 μm to about 40 μm.

12. A charging device as claimed in claim 10, wherein said flexible member is made from electrically conductive resin and has a thickness in a range from about 100 μm to about 300 μm.

* * * * *

UNITED STATES PATENT AND TRADEMARK OFFICE

CERTIFICATE OF CORRECTION

PATENT NO. : 5,243,387

DATED September 7, 1993

INVENTOR(S) : Akihito Ikegawa

It is certified that error appears in the above-indentified patent and that said Letters Patent is hereby corrected as shown below:

In col. 2, line 3, after "image," delete "," (comma).

In col. 2, line 49, after "of" insert --a--.

In col. 3, line 14, change "$10^6$" to --$10^4$--.

In col. 3, line 31, change "parts(s)" to --part(s)--.

Signed and Sealed this

Twenty-second Day of March, 1994

Bruce Lehman

*Attest:*

BRUCE LEHMAN

*Attesting Officer*

*Commissioner of Patents and Trademarks*